United States Patent [19]

Edelman et al.

[11] Patent Number: 4,838,955

[45] Date of Patent: Jun. 13, 1989

[54] METHOD FOR THE MANUFACTURE OF HARD STEEL SHEET FROM AL-KILLED CONTINUOUS-CAST CARBON-MANGANESE STEEL

[75] Inventors: Arie B. C. Edelman, Heiloo; Jan B. Kleijn, Krommenie; Maarten A. de Haas, Heerhugowaard; Thomas M. Hoogendoorn, Aerdenhout, all of Netherlands

[73] Assignee: Hoogovens Groep B.V., IJmuiden, Netherlands

[21] Appl. No.: 127,377

[22] Filed: Dec. 2, 1987

Related U.S. Application Data

[62] Division of Ser. No. 890,290, Jul. 29, 1986.

[30] Foreign Application Priority Data

Jul. 29, 1985 [NL] Netherlands ..... 8502145

[51] Int. Cl.[4] ..... C21D 8/02

[52] U.S. Cl. ..... 148/2; 148/12 C; 148/12 D; 148/12 F; 204/37.3

[58] Field of Search ..... 148/2, 12 C, 12 D, 12 F; 204/37.3

[56] References Cited

U.S. PATENT DOCUMENTS 4,698,103 10/1987 Hoogendoorn et al. ..... 204/37.3

FOREIGN PATENT DOCUMENTS 243123 10/1986 Japan ..... 148/12 D

*Primary Examiner*—L. Dewayne Rutledge
*Assistant Examiner*—George Wyszomierski
*Attorney, Agent, or Firm*—Stevens, Davis, Miller & Mosher

[57] ABSTRACT

Steel sheet manufactured from Al-killed continuous cast carbon-manganese steel and having a hardness in the range 57 to 73 HR30T is characterized by a content of 0.03 to 0.10% by weight C and 0.15 to 0.50% by weight Mn, and an amount Z in ppm of dissolved uncombined nitrogen given by $$Z \geqq 2.5 \times (H-55)$$

where H is the hardness (HR30T). In this way, hard sheet is obtained at low Mn and C contents. In manufacture of the sheet, the thickness reduction in skin-passing is dependent on the uncombined nitrogen content and an aging by heat treatment is performed after skin-passing.

5 Claims, 1 Drawing Sheet

METHOD FOR THE MANUFACTURE OF HARD STEEL SHEET FROM AL-KILLED CONTINUOUS-CAST CARBON-MANGANESE STEEL

This is a division of application Ser. No. 890,290 filed July 29, 1986.

BACKGROUND OF THE INVENTION

1. Field of the Invention

The invention relates to hard steel sheet manufactured from Al-killed continuous cast carbon-manganese steel. The invention also relates to a method for manufacturing such sheet, including the steps of continuously casting the steel, hot-rolling, cold-rolling, continuously annealing and skin-passing (cold finishing).

2. Description of the Prior Art

In this specification and claims, by the term steel sheet is meant a product which has been hot-rolled, cold-rolled, annealed and skin-passed and which has a thickness of 0.1 to 0.5 mm. Such a sheet may additionally be provided with a metallic surface-layer such as for example tin or chrome/chromic oxide (ECCS) or with a chemical surface layer such as lacquer. Steel sheet is obtainable in various hardness categories. The softer qualities of sheet are used when, in manufacturing a product therefrom, the deformation given to the sheet is large, for example in the manufacture of certain cans. The harder qualities of sheet find use when the deformation to which the sheet is subjected to less large and strength requirements are set, such as for example with can ends.

The present invention aims for example particularly at the production of sheet in the hardness categories T61, T65 and T70 of European Standard 145-78 which is sheet with a hardness HR30T of 57 and higher. The mean hardness HR30T and the range permitted in these categories are as follows:

| Hardness category | Hardness HR30T | |
|---|---|---|
| | Mean | Range |
| T61 | 61 | ±4 |
| T65 | 65 | ±4 |
| T70 | 70 | +3 −4 |

HR30T is the Rockwell hardness using the 30T Rockwell Scale.

In other Standards, such as Tin Mill Products May, 1979 of AISI (American Iron and Steel Institute) and JISG 3303 (1984) of the Japanese Institute of Standards, other hardness-category designations are given, and there are slight deviations from the ranges of European 145-78 specified above. However grades of sheet defined in such other standards are deemed to satisfy European Standard 145-78 when the mean hardness-value HR30T corresponds to one of the categories T61, T65 and T70, and the present invention extends to these corresponding grades.

There are two known methods of producing hard qualities of sheet. The first method consists in that by skin-passing a great reduction of the thickness up to 15% of the thickness before skin-passing is obtained, the material being strengthened thereby. This has not only the disadvantage that a severe skin-passing is required but also that after skin-passing the steel sheet is more anisotropic, due to variations of mechanical properties between the direction of rolling and the direction at right angles thereto, than is the case when in the skin-passing a smaller reduction in thickness is performed. This anisotropy can be serious when the steel is subsequently subjected to, for instance, deep-drawing or pressing.

The second known method consists in that a higher carbon and manganese content is used in the chemical composition of the steel than for the softer steel qualities. This makes the steel sheet harder and stronger, but a disadvantage is that steel with a higher carbon and manganese content is more expensive and offers greater resistance to deformation during cold-rolling and skin-passing. Yet another disadvantage is that different chemical compositions are needed for different hardness categories, so that a manufacturer cannot start from a standard steel suitable for a range of qualities.

SUMMARY OF THE INVENTION

The object of the invention is to provide a hard-quality steel sheet and a method for manufacturing such sheet, in which the disadvantages referred to above are wholly or partly overcome.

The steel sheet according to the invention has the following characteristics, in combination:

(a) the steel of the sheet contains, in percentage by weight, 0.03% to 0.10% carbon and 0.15% to 0.50% manganese, and (b) the steel of the sheet contains an amount of uncombined dissolved nitrogen ($N_{free}$) which for the respective hardness categories is given by the following table:

| Hardness category | $N_{free}$ (ppm) |
|---|---|
| T61 | ≧5 |
| T65 | ≧15 |
| T70 | ≧25. |

The steel sheet according to the invention thus has a chemical composition which, as regards carbon and manganese content, can correspond to that usual in soft steels. It further has a particular minimum content of free nitrogen, which is not chemically combined, and is dissolved in the steel, which is achieved by control of the aluminum/nitrogen system. This nitrogen content ($N_{free}$) can be directly determined and is equal or nearly equal to the difference between (a) the total quantity of nitrogen in the steel and (b) the quantity combined and precipitated in the form of AlN or other nitrides of aluminum or other nitrogen-binders. A suitable maximum value of $N_{free}$ is 100 ppm.

The invention can be defined without reference to European Standard 145-78 by relating the $N_{free}$ value to the hardness. In this aspect the invention provides steel sheet manufactured from Al-killed continuous cast carbon-manganese steel and having a hardness in the range 57 to 73 HR30T characterized in that (a) the steel of the sheet contains 0.03 to 0.10% by weight C and 0.15 to 0.50% by weight Mn, and (b) the steel of the sheet contains an amount Z in ppm of dissolved uncombined nitrogen given by $$Z \geqq 2.5 \times (H-55)$$

where H is the hardness of the sheet (HR30T).

Preferably, the chemical composition of the steel comprises ≦0.065% acid-soluble aluminium $Al_{as}$ (as =acid-soluble) and 0.004% to 0.010% N. This preferred upper limit of aluminium-content arises because the solubility of the nitrogen in the steel decreases with increasing aluminium-content. The lower limit of the nitrogen-content is dependent on the desired amount of free nitrogen $N_{free}$ in the steel sheet, and the upper limit is determined by its suitability to cold-rolling. In addition, the chemical composition of the steel comprises for example max. 0.020 P, max. 0.020 S, max. 0.030 Si, the remainder being iron and the usual impurities.

Preferably therefore, the steel of the sheet of the invention has the composition, in % by weight:

| | |
|---|---|
| C | 0.03 -0.10 |
| Mn | 0.15 -0.50 |
| $Al_{as}$ (acid soluble Al) | 0 -0.065 |
| N (including said dissolved uncombined nitrogen) | 0.004 -0.010 |
| P | 0 -0.02 |
| S | 0 -0.02 |
| Si | 0 -0.03 |

The steel sheet according to the invention is further characterized by a high yield-strength, which for the mentioned hardness-categories, of European Standard 145-78 lies within the following limits:

| Hardness category | Yield strength ($N/mm^2$) |
|---|---|
| T61 | 400 ± 50 |
| T65 | 450 ± 50 |
| T70 | 500 ± 50 |

The steel sheet of the invention can alternatively be defined by relating the $N_{free}$ value to the yield strength. In this aspect, the invention provides steel sheet manufactured from Al-killed continuous cast carbon-manganese steel and having a hardness in the range 57 to 73 HR30T characterized in that (a) the steel of the sheet contains 0.03 to 0.10% by weight C and 0.15 to 0.50% by weight Mn, and (b) the steel of the sheet has a yield strength Y ($N/mm^2$) in the range 350 to 550 and contains an amount Z in ppm of dissolved uncombined nitrogen given by $$Z \geqq 0.2 \times (Y-325).$$

A method of manufacturing the steel sheet according to the invention comprising the steps of continuous casting of the steel and hot-rolling, cold-rolling, continuous annealing and skin-passing is characterised in that, in combination:

(a) the reduction in thickness TR-RED during skin-passing, expressed as a percentage, lies for the respective hardness-categories of European Standard 145-78 in the respective ranges:

| Hardness category | TR-RED |
|---|---|
| T61 | 0.5-1.5 |
| T65 | 1.5-2.5 |
| T70 | 2.5-3.5 |

(b) after the skin-passing, the steel is aged by a thermal after-treatment in which by fixing (saturating) free dislocations with free nitrogen, both the hardness and the yield strength are increased.

The method of the invention is alternatively characterized in that (a) the thickness reduction TR-RED (in %) during the skin-passing step is given by $$H/5-11.5 \geqq (TR\text{-}RED) \leqq H/5-10.5$$

where H is the final hardness of the sheet (HR30T) with the proviso that TR-RED ≧ 0.5, and (b) after the skin-passing step a thermal (heat) after-treatment is carried out in which free dislocations produced in the steel by the skin-passing are fixed by the uncombined nitrogen, so as to increase the hardness and yield-strength above the values after the skin passing.

The thermal after-treatment in the method of the invention achieves the aging of the steel by fixing, in the free dislocations created in the sheet by skin-passing, the free uncombined nitrogen dissolved in the steel. This thermal after-treatment may be combined with any other suitable thermal treatment of the skin-passed steel, e.g. a thermal treatment already known for another purpose.

For example, the steel sheet is tinned electrolytically after the skin-passing and the thermal after-treatment consists of fusing the tin-layer of the tinplate which has been deposited electrolytically. A second possibility is that the steel sheet is lacquered after skin-passing and the thermal after-treatment is to enamel the lacquer-layer of the lacquered sheet. The thermal after-treatments applied in these two embodiments, consisting of the fusing of the tin-layer or the enamelling of the lacquer layer, respectively, are apparently sufficient to bring about saturation of the free discolorations with free nitrogen.

Preferably, the coiling temperature of the sheet in the hot-rolling is less than 600° C., since in this case the free nitrogen remains largely in solution rather than having been converted into aluminium nitride as the coil cools. Further, in this way uniform distribution of free nitrogen over the whole length of the coil is achieved.

BRIEF INTRODUCTION OF THE DRAWING

FIG. 1 in the attached drawing is a graph showing the relationship in the practice of this invention between the yield strength and $N_{free}$ at various values of thickness reduction TR-RED.

DESCRIPTION OF THE DRAWING

The method of the invention is exemplified by the functional relationship, illustrated in FIG. 1, between the quantity of free nitrogen $N_{free}$ present after the continuous annealing, the reduction in thickness TR-RED in the skin-passing and the resulting hardness and yield-strength conferred by the thermal after-treatment which follows the skin-passing step. With a thickness reduction in the range of 0.5% to 1.5% (i.e. a 1% level of thickness reduction) a hardness is obtained that increases with increase in the quantity of free nitrogen $N_{free}$ present, when the quantity of free nitrogen $N_{free}$ is less than 15 ppm. When the quantity of free nitrogen $N_{free}$ exceeds 15 ppm, the hardness does not increase further. For a quantity of free nitrogen $N_{free}$ greater than 15 ppm hardness-category T61 is thus produced with a reduction at the 1% level.

EXAMPLE

Figure 1:
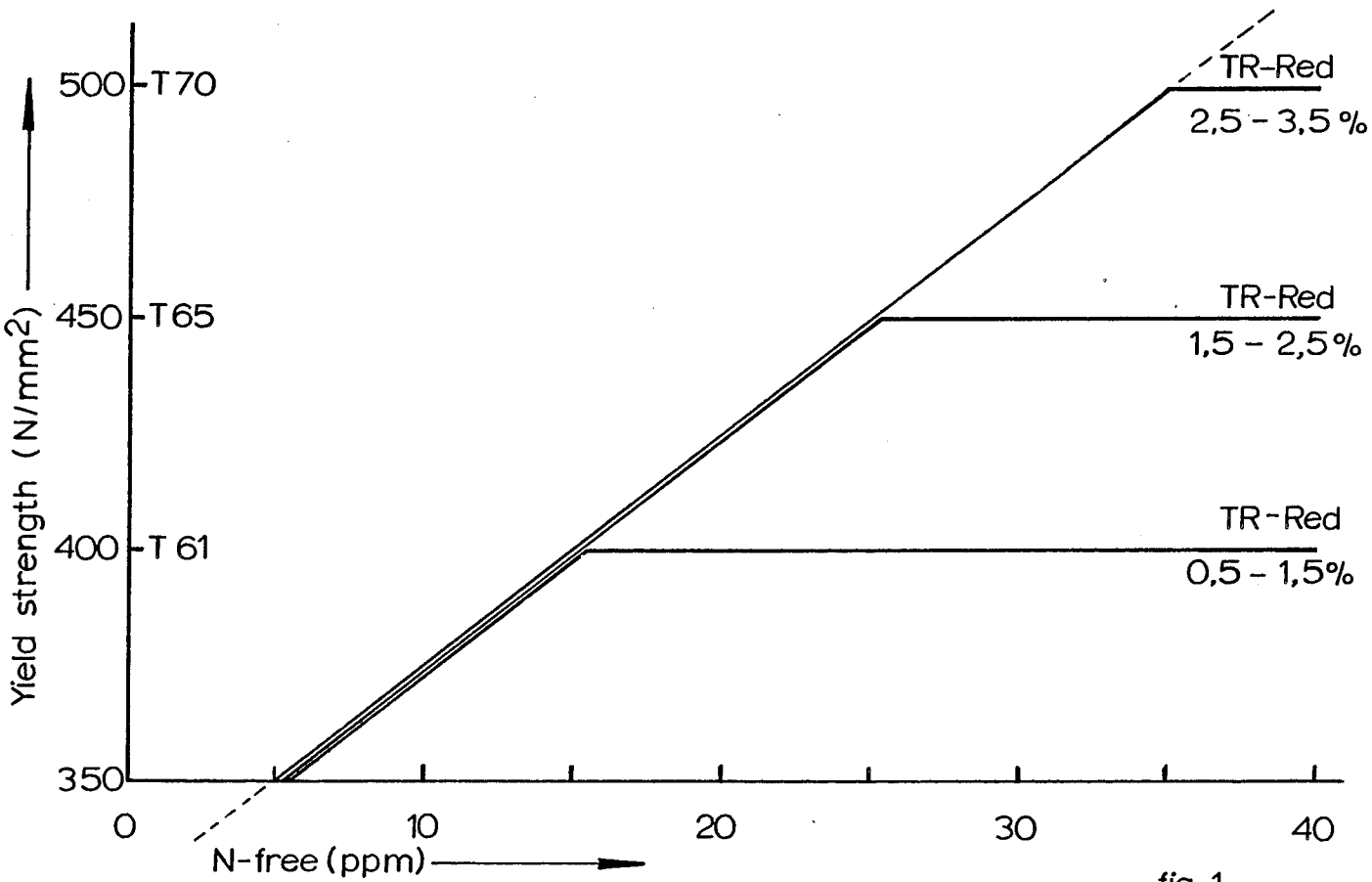
FIG. 1 also shows that for a quantity of free nitrogen $N_{free}$ in excess, for example, of 35 ppm, steel sheet in the hardness-categories T61, T65 and T70 can all be achieved starting from one and the same steel, by employing appropriate thickness-reductions during cold-finishing (skin-passing). That is to say, for the same steel at 35 ppm $N_{free}$, TR-RED of 1% gives a steel sheet of category T61, TR-RED of 2% gives a steel sheet of category T65 and TR-RED of 3% gives a steel sheet of category T70.

A preferred embodiment of the invention is now described as a non-limitative example. The results here given are for a series of heats (steel compositions) carried out according to normal production processes. Each heat had a composition defined by the ranges (% by weight)

| | |
|---|---|
| C | 0.03 -0.10 |
| Mn | 0.15 -0.50 |
| $Al_{as}$ (acid soluble Al) | 0 -0.065 |
| N (including said dissolved uncombined nitrogen) | 0.004 -0.010 |
| P | 0 -0.02 |
| S | 0 -0.02 |
| Si | 0 -0.03 |

Each heat was continuously cast and the steel then hot-rolled with a coiling temperature of less than 600° C. The steel was cold-rolled into sheet with a cold-rolling reduction of 85–90%. The sheet was continuously annealed at above 640° C. to obtain recrystallisation in a Mohri cycle. The sheet was the skin-passed with a skin-pass reduction of about 0.8%, and thereafter electrolytically tinned. A heat treatment to fuse the tin layer was finally performed, which also caused aging of the steel. The temper class (hardness class) and yield strength obtained in each case showed dependency on the uncombined nitrogen content ($N_{free}$) in accordance with the line for TR-RED of 0.5–1.5% in FIG. 1.

There are many advantages of the sheet according to the invention and the method of manufacturing it. First, because of the low carbon and manganese contents, the steel has a "light" composition, so that the sheet is easier to roll than heavier compositions, since the hardness is obtained by the thermal after-treatment. The "light" composition is also cheaper. In addition, the steel sheet is isotropic as a result of the small thickness-reduction in skin-passing. Lastly, steel of a single composition, provided the quantity of free nitrogen $N_{free}$ present is high enough, can suffice to produce different hardness-categories, by skin-passing with appropriate small reductions in skin-passing.

What is claimed is:

1. Method of manufacturing steel sheet having a hardness in one of the hardness categories T61, T65 and T70 of European Standard 145-78, including the steps, in the order given, of (i) continuously casting an Al-killed steel containing 0.03 to 0.10% by weight C and 0.15 to 0.50% by weight Mn (ii) hot-rolling the steel (iii) cold-rolling the steel into sheet (iv) continuously annealing the steel sheet thereby to produce a steel sheet which contains an amount of uncombined dissolved nitrogen ($N_{free}$) which for the respective hardness categories is given by the following table:

| Hardness category | $N_{free}$(ppm) |
|---|---|
| T61 | ≧5 |
| T65 | ≧15 |
| T70 | ≧25 |

(v) skin-passing the steel sheet with a thickness reduction TR-RED (in %) during said skin-passing step which for the respective hardness categories, is within the ranges given by the following table:

| Hardness category | TR-RED (%) |
|---|---|
| T61 | 0.5–1.5 |
| T65 | 1.5–2.5 |
| T70 | 2.5–3.5 |

(vi) performing a thermal (heat) after-treatment in which free dislocations produced in the steel by the skin-passing are fixed by the uncombined nitrogen, so as to increase the hardness and yield-strength above the values after the skin passing.

2. A method according to claim 1 further including tinning the steel sheet electrolytically after the skin-passing, and wherein the said thermal after-treatment consists of the fusing of the electrolytically-deposited tin layer.

3. A method according to claim 1 further including lacquering the steel sheet after the skin-passing and wherein the said thermal after-treatment consists of the enamelling of the layer of lacquer.

4. A method according to claim 1 wherein the sheet steel has a coiling temperature at the hot-rolling of less than 600° C.

5. Method of manufacturing steel sheet having a hardness in the range 57 to 75 HR30T, including the steps of (i) continuously casting an Al-killed steel containing 0.03 to 0.10% by weight C and 0.15 to 0.50% by weight Mn, (ii) hot-rolling the steel (iii) cold-rolling the steel into sheet (iv) continuously annealing the steel sheet thereby to produce a sheet which contains an amount Z in ppm of dissolved uncombined nitrogen given by $$Z \geqq 2.5 \times (H-55)$$

where H is the hardness of the sheet (HR30T)

(v) skin-passing the steel sheet with the thickness reduction TR-RED (in %) during the skin-passing step given by $$H/5 - 11.5 \leqq (\text{TR-RED}) \leqq H/5 - 10.5$$

where H is the final hardness of the sheet (HR30T) with the proviso that TR-RED≧0.5, and (vi) performing a thermal (heat) after-treatment in which free dislocations produced in the steel by the skin-passing are fixed by the uncombined nitrogen, so as to increase the hardness and yield-strength above the values after the skin passing.

* * * * *